US011105092B2

(12) United States Patent
Stahl, Jr. et al.

(10) Patent No.: US 11,105,092 B2
(45) Date of Patent: Aug. 31, 2021

(54) FIRE BLOCKING GASKET FOR WINDOW WALL CONDITIONS

(71) Applicant: Specified Technologies Inc., Somerville, NJ (US)

(72) Inventors: James P. Stahl, Jr., Princeton Junction, NJ (US); Paul Gandolfo, Doylestown, PA (US); Julio Lopes, Melbourne, FL (US)

(73) Assignee: Specified Technologies Inc., Somerville, NJ (US)

( * ) Notice: Subject to any disclaimer, the term of this patent is extended or adjusted under 35 U.S.C. 154(b) by 111 days.

(21) Appl. No.: 16/442,425

(22) Filed: Jun. 14, 2019

(65) Prior Publication Data

US 2019/0383003 A1 Dec. 19, 2019

Related U.S. Application Data

(60) Provisional application No. 62/685,587, filed on Jun. 15, 2018.

(51) Int. Cl.

| | |
|---|---|
| ***E04B 2/74*** | (2006.01) |
| ***E04B 1/94*** | (2006.01) |
| ***E04B 2/58*** | (2006.01) |

(52) U.S. Cl.

CPC ..... *E04B 1/948* (2013.01); *E04B 1/944* (2013.01); *E04B 1/945* (2013.01); *E04B 1/947* (2013.01); *E04B 2/58* (2013.01); *E04B 2/7411* (2013.01); *E04B 2/7457* (2013.01); *E04B 2002/7481* (2013.01)

(58) Field of Classification Search

CPC ..... E04F 13/0898; E06B 5/164; E06B 5/165; E06B 5/167; E06B 3/54; E06B 3/5409; E06B 3/5427; E04B 2/88; E04B 2/885; E04B 2/90; E04B 2/96; E04B 2/962; E04B 2/965; E04B 2/967; E04B 2/7411; E04B 2/74019; E04B 2/745; E04B 2/7455; E04B 1/948; E04B 1/945; E04B 1/944; E04B 1/947; E04B 1/94

See application file for complete search history.

(56) References Cited

U.S. PATENT DOCUMENTS

| | | | | | |
|---|---|---|---|---|---|
| 4,566,242 | A * | 1/1986 | Dunsworth | ..... | E04B 1/946 52/396.01 |
| 4,588,523 | A * | 5/1986 | Tashlick | ..... | C09K 21/00 106/18.12 |
| 4,967,527 | A * | 11/1990 | Gohlke | ..... | E04B 1/948 250/517.1 |
| 4,999,962 | A * | 3/1991 | Gohlke | ..... | E04B 1/948 52/396.07 |
| 5,140,797 | A * | 8/1992 | Gohlke | ..... | E04B 1/948 52/396.01 |

(Continued)

*Primary Examiner* — Jessica L Laux

(74) *Attorney, Agent, or Firm* — Massina Pat. & TM Law PLLC

(57) ABSTRACT

A window wall assembly includes a floor slab, a first window with a bottom sill positioned atop the floor slab and a second window with a top sill positioned at a lower surface of the floor slab. A panel extends between the first and second windows such that a void is defined between the panel and the floor slab. A fire-retardant gasket is positioned within the void and in sealing contact with the floor slab and the bottom sill.

20 Claims, 4 Drawing Sheets

(56) References Cited

U.S. PATENT DOCUMENTS

| | | | | | |
|---|---|---|---|---|---|
| 5,154,029 | A * | 10/1992 | Sturgeon | E04F 13/12 | 52/235 |
| 5,326,609 | A * | 7/1994 | Gohlke | B32B 15/04 | 428/76 |
| 5,383,316 | A * | 1/1995 | Burke | F16J 15/065 | 52/218 |
| 5,461,838 | A * | 10/1995 | Heller | E04B 1/948 | 52/167.1 |
| 5,765,332 | A * | 6/1998 | Landin | E04B 1/948 | 52/235 |
| 6,112,488 | A * | 9/2000 | Olson | E04B 1/948 | 52/167.1 |
| 6,128,874 | A * | 10/2000 | Olson | E04B 1/948 | 52/232 |
| 6,131,352 | A * | 10/2000 | Barnes | E04B 1/948 | 52/396.01 |
| 8,991,121 | B1 * | 3/2015 | Baker | E04B 2/965 | 52/235 |
| 9,512,614 | B2 * | 12/2016 | Klein | E04B 1/948 | |
| 2002/0148178 | A1 * | 10/2002 | Farag | E06B 5/165 | 52/204.1 |
| 2008/0172960 | A1 * | 7/2008 | Hilburn | E04F 13/0889 | 52/232 |
| 2013/0031856 | A1 * | 2/2013 | Pilz | E04B 2/7457 | 52/232 |
| 2013/0061544 | A1 * | 3/2013 | Stahl, Jr. | A62C 2/10 | 52/232 |
| 2016/0097197 | A1 * | 4/2016 | Pilz | E04B 2/7411 | 52/232 |
| 2016/0130802 | A1 * | 5/2016 | Pilz | E04B 1/948 | 52/232 |
| 2017/0198473 | A1 * | 7/2017 | Pilz | E04B 2/7411 | |
| 2018/0371748 | A1 * | 12/2018 | Klein | B32B 9/045 | |

* cited by examiner

FIRE BLOCKING GASKET FOR WINDOW WALL CONDITIONS

This application claims the benefit of U.S. Provisional Application No. 62/685,587, filed on Jun. 15, 2018, the contents of which are incorporated herein by reference.

FIELD OF THE INVENTION

This invention relates to a fire blocking gasket made from fire-retardant material that seals between the edge of slab and infill panel used to conceal the edge of slab in window wall conditions where the upper and lower sills of the window wall are cantilevered.

BACKGROUND OF THE INVENTION

Referring to FIGS. 1-3, a prior art window wall assembly 10 will be described. A window wall assembly 10 is an exterior wall design wherein the upper and lower sills 16, 18 of the windows 14 are cantilevered relative to the floor slabs 12. Each window 14 includes the upper and lower sills 16, 18 and glass 15 extending therebetween. On each floor, the lower sill 16 sits directly atop the floor slab 12 and the upper sill 18 is connected directly to the bottom of the floor slab 12. The window wall 10 is usually caulked with silicone caulk 24 as additional weather sealing at the interfaces with the slab 12.

An infill panel 20 or decorative cover may be used to conceal the edge of the slab 12 and provide more of an aesthetic look to the building. A small void 22 typically extends between the panel 20 and the edge of the slab 12. It has been found that a fire 26 starting on the lower floor may burn out the sill 18 at the bottom of the floor slab 12, which creates a flue effect in the void 22 between the panel 20 and the slab 12, as illustrated in FIGS. 2 and 3. The flue effect causes heat and flames 26 to be channeled upwards to the sill 16 and caulking 24. The caulking will typically burn out and allow passage of the channeled heat and flames 26 to the upper floor. As such, the void 22 may cause the window wall assembly 10 to not satisfy fire safety codes.

SUMMARY OF THE INVENTION

In at least one embodiment, the present invention provides a window wall assembly includes a floor slab, a first window with a bottom sill positioned atop the floor slab and a second window with a top sill positioned at a lower surface of the floor slab. A panel extends between the first and second windows such that a void is defined between the panel and the floor slab. A fire-retardant gasket is positioned within the void and in sealing contact with the floor slab and the bottom sill.

In at least one embodiment, the fire-retardant gasket is manufactured from an intumescent material.

In at least one embodiment, a reinforcing mesh is incorporated within the fire-retardant gasket.

In at least one embodiment, the fire-retardant gasket is positioned in place during construction of the window wall assembly.

In at least one embodiment, the fire-fire-retardant gasket is connected to the floor slab.

In at least one embodiment, the fire-retardant gasket is connected to the floor slab with integrated pressure-sensitive tape.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
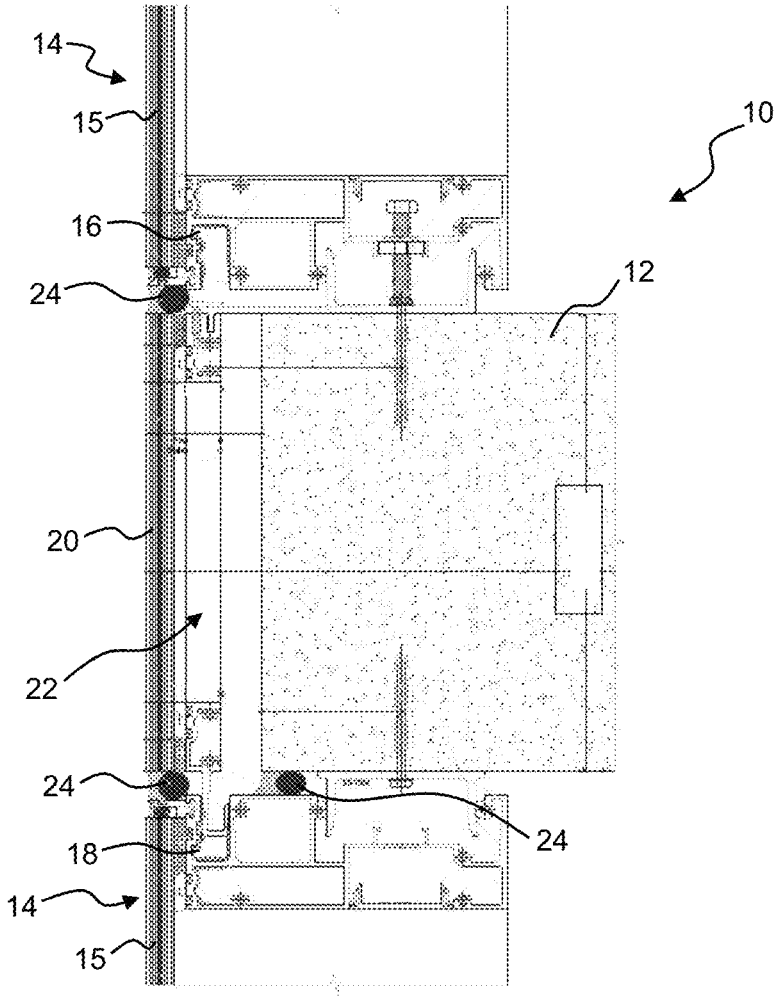
Fig. 1 (Prior Art)
FIG. 1 is a side elevation view of a prior art window wall assembly.
Figure 2:
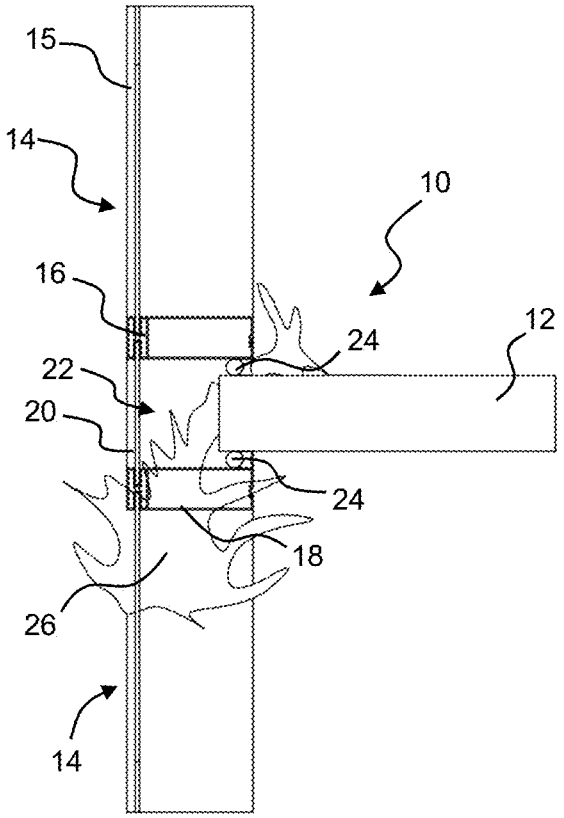
Fig. 2 (Prior Art)
FIG. 2 is a perspective view of the prior art window wall assembly of FIG. 1 illustrating fire penetration from the lower floor to the upper floor.
Figure 3:
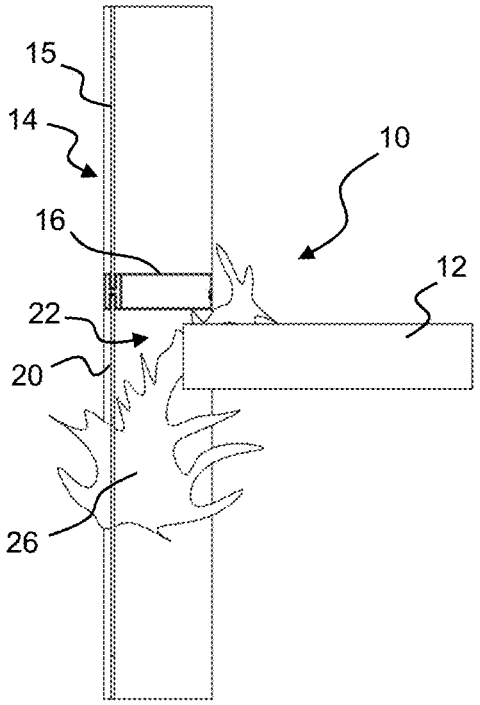
Fig. 3 (Prior Art)
FIG. 3 is a side elevation view of the prior art window wall assembly of FIG. 1 illustrating fire penetration from the lower floor to the upper floor.
Figure 4:
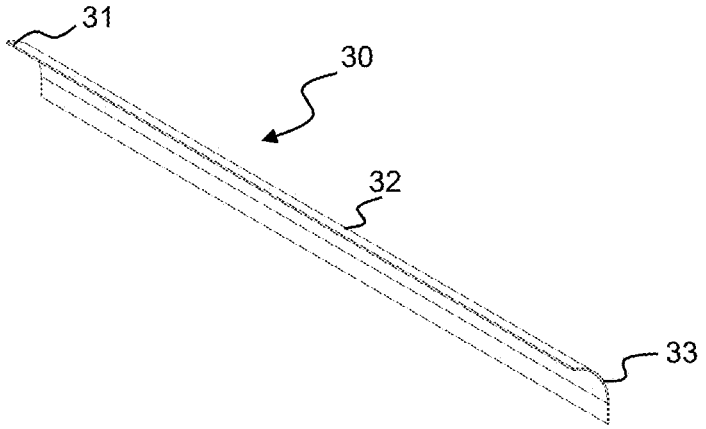
FIG. 4 is a perspective view of a fire blocking gasket in accordance with an embodiment of the invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 5:
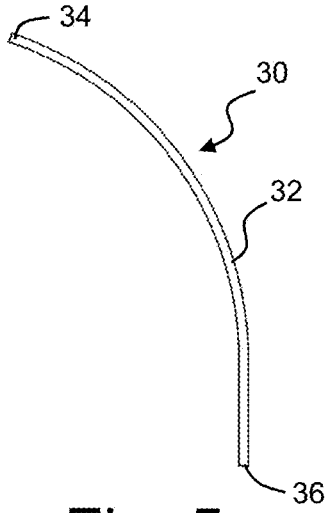
FIG. 5 is a side elevation view of the fire blocking gasket of FIG. 4.

Referring to FIGS. 4-8, an exemplary embodiment of a window wall assembly 50 incorporating a fire-retardant gasket 30 will be described. The fire-retardant gasket 30 has an elongate body 32 extending between ends 31, 33. The illustrated elongate body 32 has an arcuate configuration as shown in FIG. 5, with a top edge 34 and a bottom edge 36. The elongated body 32 may have other configurations, for example, wedge shaped, cubical, triangular or the like. In the illustrated embodiment, the fire-retardant gasket body 32 is manufactured from an intumescent material configured to expand when exposed to high heat. The invention is not limited to intumescent material, but may utilize other fire-retardant materials, for example but not limited to, mineral wool, a closed cell flame retardant Neoprene, or a fire-retardant rubber polymer. Additionally, the gasket body 32 may incorporate a mesh, including but not limited to a fiberglass mesh, to reinforce the insulative char produced by expansion of the intumescent material.

Figure 6:
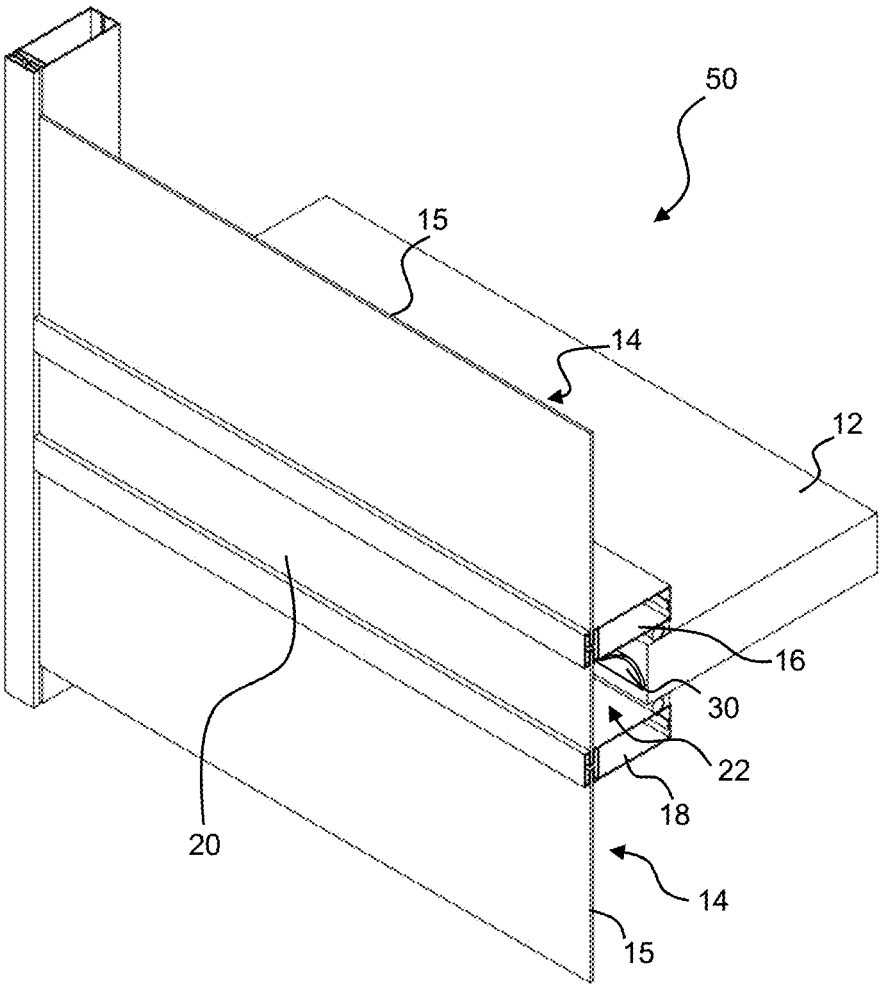
FIG. 6 is a perspective view of a window wall assembly incorporating a fire blocking gasket in accordance with an embodiment of the invention.
Figure 7:
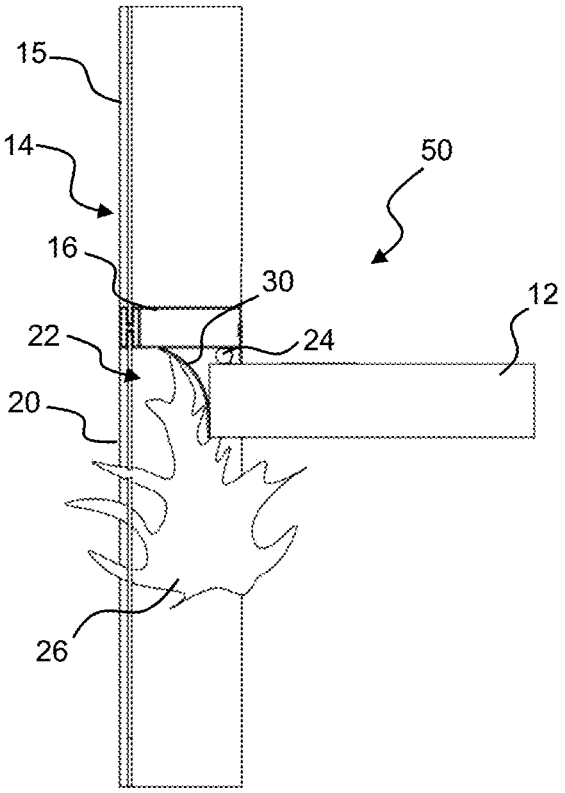
FIG. 7 is a side elevation view of the window wall assembly of FIG. 6 illustrating initial fire breakout.
Figure 8:
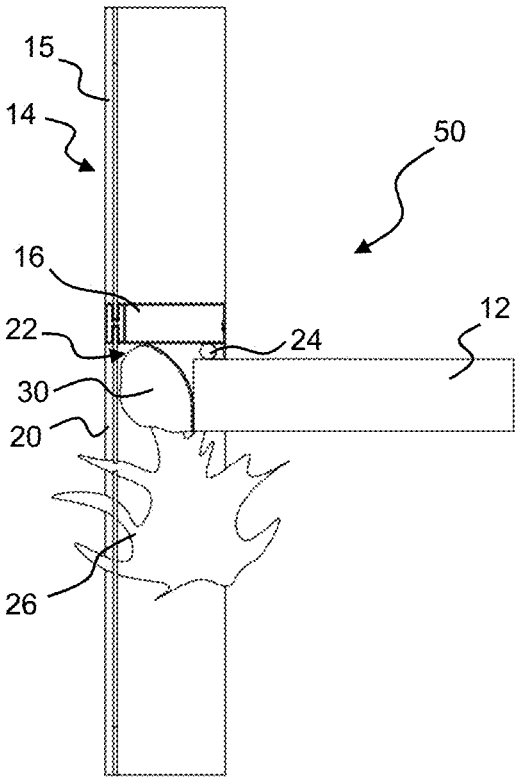
FIG. 8 is a side elevation view similar to FIG. 7 illustrating expansion of the fire blocking gasket after exposure to fire or excessive heat.

Referring to FIGS. 6 and 7, the fire-retardant gasket 30 is positioned within the void 22 with the lower edge 36 sealing against the slab 12 and the upper edge 34 sealing against the sill 16. The gasket 30 is positioned in place during the construction process. The gasket 30 may be fastened, glued or the like to edge of the slab 12, including but not limited with integrated pressure-sensitive tape. The configuration of the gasket body 32 may maintain the gasket in contact with the sill 16 or alternatively, the gasket body 32 may be secured to the sill 16. As shown in FIGS. 7 and 8, in the event that fire 26 infiltrates the void 22, the fire-retardant gasket 30 seals between the slab 12 and the sill 26 and retards the progress of the fire and heat therebetween. In the illustrated embodiment, the gasket body 32 is manufactured from an intumescent material and expands, as shown in FIG. 8, in response to the heat and further seals the void 22.

Under laboratory conditions, the applicant tested fire resistance of a window wall assembly 10 as shown in FIG. 1 and that of a window wall assembly 50 in accordance with the invention as illustrated in FIG. 6. In the first test of the prior art window wall assembly 10, the fire burned out the sill at the bottom of the floor and some of the infill panel, but not all of it. This created a flue effect and the heat and flames were channeled upwards. Eventually, the upper sill bearing on the floor eroded and there was flaming at 51 minutes.

In the second test of the window wall assembly 50, the fire-retardant gasket 30 was manufactured from an intumescent material and was reinforced with a fiberglass mesh. In the test, the intumescent gasket 30 blocked the direct path for heat and flame. The gasket 30 expanded under the heat of the fire and helped to prevent the flue effect from burning out the upper sill. It improved performance to 92 minutes. While the improvement in performance was over 41 minutes, additionally the temperatures measured along the sealant bead 24 were much cooler with the window wall assembly 50 including the fire-retardant gasket 30. Temperatures measured in the first test on the sealant and on the aluminum sill were 527° F. and 1025° F., respectively at the 51 minute mark when flaming occurred. Temperatures measured in the second test in the same positions were 409° F. and 813° F., respectively, at the 51 minute mark.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A window wall assembly comprising:

a floor slab having a top surface, a bottom surface and an exterior surface extending therebetween;

a first window with a bottom sill positioned atop the floor slab such that an interior edge of the bottom sill is positioned inwardly of the floor slab exterior surface to define an inside corner between the bottom sill and the floor slab exterior surface;

a second window with a top sill positioned at the lower surface of the floor slab;

a panel extending between the first and second windows such that a void is defined between the panel and the floor slab; and a fire-retardant gasket positioned within the void and in sealing contact with the floor slab exterior surface and a bottom surface of the bottom sill.

2. The window wall assembly of claim 1 wherein the fire-retardant gasket is manufactured from an intumescent material.

3. The window wall assembly of claim 2 wherein a reinforcing mesh is incorporated within the fire-retardant gasket.

4. The window wall assembly of claim 1 wherein the fire-retardant gasket is manufactured from mineral wool, closed cell flame retardant neoprene, a fire-retardant polymer or a combination thereof.

5. The window wall assembly of claim 1 wherein the fire-retardant gasket is positioned in place during construction of the window wall assembly.

6. The window wall assembly of claim 1 wherein the fire-fire-retardant gasket is connected to the floor slab.

7. The window wall assembly of claim 6 wherein the fire-retardant gasket is connected to the floor slab with integrated pressure-sensitive tape.

8. The window wall assembly of claim 6 wherein the fire-retardant gasket is connected to the bottom sill.

9. The window wall assembly of claim 6 wherein the fire-retardant gasket is configured such that the fire-retardant gasket has a natural bias into sealing contact with the bottom sill.

10. The window wall assembly of claim 1 wherein the fire-retardant gasket has a natural C-shaped cross-section.

11. A method of sealing a window wall assembly including a floor slab having a top surface, a bottom surface and an exterior surface extending therebetween, a first window with a bottom sill positioned atop the floor slab such that an interior edge of the bottom sill is positioned inwardly of the floor slab exterior surface to define an inside corner between the bottom sill and the floor slab exterior surface, a second window with a top sill positioned at the lower surface of the floor slab, and a panel extending between the first and second windows such that a void is defined between the panel and the floor slab, the method comprising:

positioning a fire-retardant gasket within the void such that a portion thereof is in sealing contact with the floor slab exterior surface and a portion thereof is in sealing contact with a bottom surface of the bottom sill.

12. The method of claim 11 wherein the fire-retardant gasket is manufactured from an intumescent material.

13. The method of claim of claim 12 wherein a reinforcing mesh is incorporated within the fire-retardant gasket.

14. The method of claim of claim 11 wherein the fire-retardant gasket is manufactured from mineral wool, closed cell flame retardant neoprene, a fire-retardant polymer or a combination thereof.

15. The method of claim of claim 11 wherein the fire-retardant gasket is positioned in place during construction of the window wall assembly.

16. The method of claim of claim 11 wherein the fire-fire-retardant gasket is connected to the floor slab.

17. The method of claim of claim 16 wherein the fire-retardant gasket is connected to the floor slab with integrated pressure-sensitive tape.

18. The method of claim of claim 16 wherein the fire-retardant gasket is connected to the bottom sill.

19. The method of claim of claim 16 wherein the fire-retardant gasket is configured such that the fire-retardant gasket has a natural bias into sealing contact with the bottom sill.

20. The method of claim of claim 11 wherein the fire-retardant gasket has a natural C-shaped cross section.

* * * * *